US005331380A

United States Patent [19]

Nasset

[11] Patent Number: 5,331,380

[45] Date of Patent: Jul. 19, 1994

[54] COPY REPRODUCTION HOLDING AND ALIGNMENT LAYOUT APPARATUS

[76] Inventor: William J. Nasset, 10333 Leverman Rd. SE., Ausmville, Oreg. 97325

[21] Appl. No.: 909,611

[22] Filed: Jul. 7, 1992

[51] Int. Cl.[5] ..... G03G 21/00

[52] U.S. Cl. ..... 355/230; 33/616; 211/47; 355/231

[58] Field of Search ..... 355/200, 201, 202, 230, 355/231, 75; 211/45, 47; 33/616; 269/303, 315, 291; 40/341, 352, 357

[56] References Cited

U.S. PATENT DOCUMENTS

| | | | |
|---|---|---|---|
| 3,152,528 | 10/1964 | Pendry | 355/230 |
| 3,957,370 | 5/1976 | Vola | 355/231 X |
| 3,972,613 | 8/1976 | Plumadore | 355/230 X |
| 4,009,954 | 3/1977 | Ritzerfield | 355/230 X |
| 4,454,210 | 6/1984 | Ariyama et al. | 355/231 X |
| 4,523,831 | 6/1985 | Yokoo et al. | 355/231 |
| 4,727,400 | 2/1988 | Ito | 355/231 X |
| 5,138,465 | 8/1992 | Ng et al. | 358/153 |
| 5,179,454 | 1/1993 | Shinada | 355/234 X |

FOREIGN PATENT DOCUMENTS

| | | | |
|---|---|---|---|
| 0242638 | 10/1991 | Japan | 355/231 |

*Primary Examiner*—Leo P. Picard
*Assistant Examiner*—Christopher Horgan

[57] ABSTRACT

A portable hand held photo copy reproduction holding device for use with black/white or color photography or photo reproduction and which has transparent copy window panel which is attached to a layout board structure. Layout board structure has non-photogenic natured alignment grid allowing freehand alignment of subject matter and non-photo reproduction of layout board alignment grid. The layout board structure also has a transparent copy window panel adjoined to layout board structure at a pivot point that allows opening and closing in a book like or tablet like manner. Layout board structure and copy window panel work synergistically to create a static electrical energy field that holds subject matter in position without the need for any glues, tapes or other adhesive materials. Allows user to rapidly and easily arrange and rearrange subject matter. Protects reproduction equipment from paper clips staples, and other holding devices.

10 Claims, 4 Drawing Sheets

Fig. 6
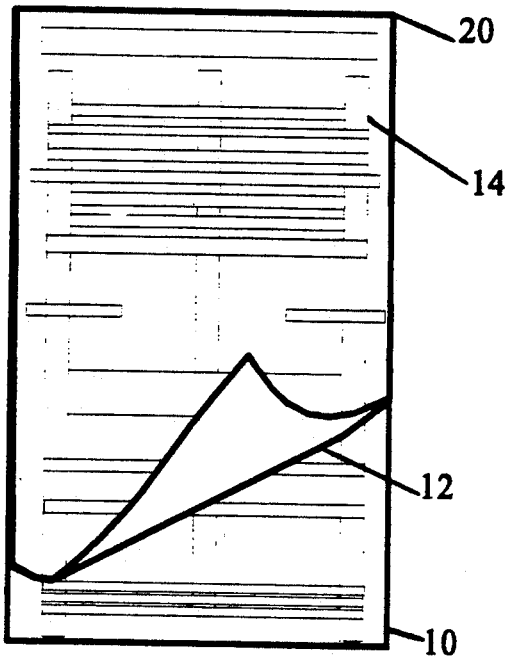
Fig. 7
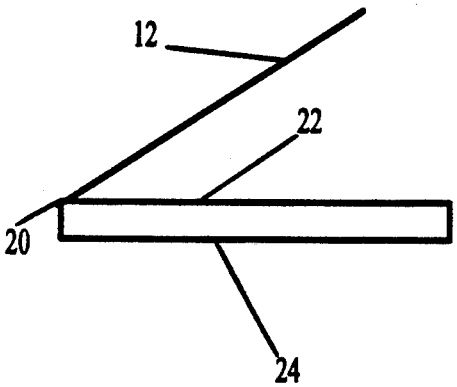
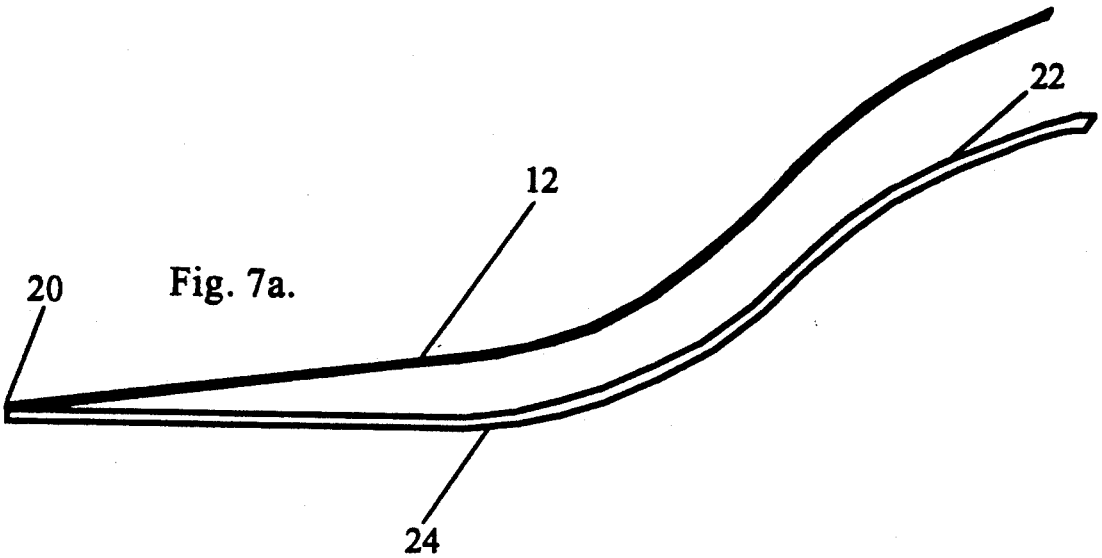
Fig. 7a.

COPY REPRODUCTION HOLDING AND ALIGNMENT LAYOUT APPARATUS

BACKGROUND

1. Field of Invention

This invention relates to copy holders, specifically to layout board holding and alignment devices used with master copy originals and photo reproduction processes.

2. Description of Prior Art

Copy reproduction equipment has become increasingly important in small and large businesses. Copy machine usage has been extended to include reproducing originals of various artwork layouts including newsletters, bulletins, flyers, and simple single sheet reproduction. Examples are the duplication of a second billing that includes a copy of the check already sent in payment; an invoice with separate shipping instructions; or a memo with special, separate routing information. Many companies that use fax machines need to overlay the original facsimile with various additional information.

Originally this type of reproduction work was performed by merely placing the original subject matter face down on the copy machine. Then the user would arrange these originals on the copy machine glass to try to obtain their desired result. Usually it would take several attempts and rearrangements of the subject matter, before the desired configuration and end results was reached. The exact image desired would then be reproduced by the photo reproduction apparatus and ultimately the final draft created. The main disadvantage of just placing the originals on the copier glass was that the subject matter had to be placed in a face-down position. Because the copy machine operator cannot view the subject matter when it is in the face down position, it is next to impossible to get it aligned correctly. Another disadvantage was that the original subject matter was laid loosely on the photocopy machine glass, allowing it to move freely from the desired position. Many times merely closing the copy machine cover will dislodge the positioning of the originals.

Another negative factor is the excessive time that it takes to correctly arrange the subject matter. This time spent by the user standing at the copy machine while they are arranging and rearranging their layout material, unnecessarily ties up the copy machine. In many offices this layout procedure was commonplace and created an undesirable bottle-neck at the copy machine or other reproduction apparatuses. Additionally, by a worker having to do their design and layout work at the copy machine and away from their assigned work area they are unable to carry on with their other daily routine work functions. This is especially true in instances where the photo reproduction equipment was placed in a back room.

Another way to prepare material for copy reproduction is to do it by freehand, using a plain sheet of white paper with no alignment device. Once the original subject matter had been arranged correctly on the sheet of paper, the individual would use some sort of glue, tape or wax adhesive to secure the subject matter. Also a person could place a sheet of paper on a lighted layout board which had a light illuminated from the back, through a grid, which cast a faint shadow onto the plain sheet of paper so the original material could be arranged. These methods were commonly referred to as paste-up work.

All of the previously practiced methods have primarily the same basic pit-falls. Without the assistance of an alignment grid, layout work is time consuming and the original subject matter often can not be arranged quickly or correctly the first time. It was difficult to align subject matter without the use of some sort of an aligning device. Furthermore, they required the use of an adhesive materials. Nevertheless if the desired end results were not obtained the first time after the photo reproduction was completed, the user was faced with the problem of rearranging the original subject matter after it had been fixed in position by the adhesive. Often, while attempting to get the subject matter removed from its original settings so it could be rearranged correctly, it would become torn or damaged. Many times the adhesive materials alone defaced or caused damage to the originals.

There are many types of sheet holding devices which are collectively and loosely named copy holders. They range from different types of carrier sheets to copy protector holders. There are also forms of transparent sheet holders that fall into the category of display holders. Each designed to display and hold variable information. Examples of display transparencies are restaurant menus, price sheets, or three-holed sheet holders that snap into three-ring binders. As of this time inventors have made little improvement in the field to develop efficient copy reproduction holders; especially as related to portable or hand-held layout boards for use in photo reproduction work.

The previously mentioned sheet holding devices are only marginally related prior art. The closest related of these prior arts to my invention is the carrier sheet. Which is used with some of the newer fax machines. The carrier sheets are used for feeding thin or small documents through these reproduction machines. One example of this type of usage is with the Sharp Electronic Corporation. This company has a carrier sheet included with their fax machine. It is called a carrier sheet and bears the code number PSHEZ2400SCZZ. It does not have patent numbers on the sheet, nor is any patent mentioned in the accompanying literature. However it is in public use. To my knowledge, this product is not patented. It is merely designed to be used as a document protector and carrier sheet. The purpose of the carrier sheet is to assist the user in automatic document feed operations and to reduce paper jamming during automatic document feed operations. It is not designed to be used as a layout board and alignment apparatus.

All of the sheet protectors, sheet holders, carrier sheet layouts and design boards heretofore known suffer from a number of one or more of these disadvantages:

(a) They lack portability. Draft tables and layout boards are stationary or large in design and require workers to leave their normal assigned work areas to do design and layout work. When the art work is completed, it must be transported to the photo reproduction equipment. If the desired results are not met after the photo reproduction process is completed, the worker must then go back to the drafting table or light board and redo their design and layout work.

(b) They do not have a non-photogenic natured grid. Sheet holders and carrier sheets lack a non-photogenic natured alignment grids and cannot be used effectively in the alignment of art work. Many reproduction processes must take place in order for the worker to achieve the desired end results. This is a waste of time and photo reproduction supplies.

(c) They do not have a freely pivoting transparent sheet panel window to allow quick and easy access to subject matter while doing photo reproduction work.

(d) They need an adhesive substance to affix the original art work to the draft sheet. These glues, tapes, or wax compounds subtract from the reusability of the original art work. If one uses a wax compound, the wax eventually bleeds through the original and damages the photogenic quality.

(e) They are not reusable. Single sheet layout paper that has a non-photogenic grid still requires the use of adhesive substances during paste up. Therefore the sheet of paper and original art work lack reusability or are at risk of suffering damage. The user is subjected to the cost of replenishing non-photogenic paper and original art work.

(f) They lack rapidness of rearrangement. Layout and design boards that require adhesive substances do not let the worker rapidly rearrange the artwork. A great deal of time is involved trying to dislodge the fixed originals from their set position, to reaffix the material and to align the new preferred design.

(g) They are not designed to be used as art work layout devices. Copy holders sheet holders and carrier sheets are not designed to work as layout boards. They simply lack the combination of components needed to properly facilitate design and layout work.

OBJECTS AND ADVANTAGES

Several objects and advantages of the present invention are:

(a) to provide a layout board structure that assists the user in accurate, correct and trouble free positioning during emplacement in reproduction machines;

(b) to provide protection to lens or copy glass to prevent damage caused by using paper clips, staples and other paper holding devices;

(c) to provide a layout board structure that can be used at the employee's assigned work area during the layout and design phase of the process. The completed art work can then be conveniently and easily transported to the reproduction machine for rapid copying;

(d) to provide a layout board structure that works in conjunction with a copy window panel to synergistically create a static electrical energy field. The copy window serves as a mechanism to temporarily secure artwork in place and assists in design stability of art work during the reproduction process;

(e) to provide layout board structure with a reusable background that does not require the use of damage causing adhesive substances;

(f) to provide a layout board structure incorporated with a non-photogenic natured alignment method for easier and more effective positioning and repositioning of art work originals;

(g) to provide a rapid and trouble free means of rearranging artwork by employing the use of a layout board structure with a pivoting transparent copy window; and (h) to provide a layout board structure that can be used with both black and white and color reproduction.

Further objects and advantages are the user is free to carry out normal work area functions while doing design layout out tasks because of the layout board portability. When the master original for photo reproduction is complete the user can go to the copy reproduction apparatus and make a copy of their layout originals. If the layout board is used at the work station, there will not be an undesirable bottle-neck in the photo reproduction machine area. If, after the photo reproduction process is completed, the reproduction is not adequate, the subject matter can quickly and easily be rearranged on the layout board. It is simply a matter of opening the copy window panel, realigning the existing configuration and using the non-photogenic natured alignment device to assist with the new design. Because of the absence of glues, tapes, and wax adhesives, neither the original art work nor the non-photogenic layout board structure are placed in jeopardy of being damaged or defaced. The layout board structure can be used many times to save the cost of buying additional materials.

There are numerous other benefits related to the usefulness of the layout and design board. Following are some examples of additional benefits: 1. It is easier to correctly position master copies in the copy machine while they are encased in the layout board structure than it is to place small single sheets of paper on the copy machine glass. 2. Master copies will not become dislodged from their correct position when closing the copy machine cover. 3. The layout board structure will straighten creases in folded originals and rolled up fax paper and thin, thermal sensitive paper. 4. If paper holding devices, such as paper clips or staples are used, they will not have to be removed prior to photo reproduction. 5. When the original subject matter is placed on the layout board structure using the copy window panel, the photo equipment is protected from the metal holding devices. There is obviously a need to protect the glass as copy machine manufacturers have created a magnetic holding area for the purpose of retaining and storing holding devices that damage glass. 6. Time is saved by eliminating the need to remove paper clips or staples.

DRAWINGS FIGURES

In the drawings, the figures show various views, aspects, functions, and desired embodiments of the present invention. The numbers show separate parts and functions. Closely related figures have alphabetical suffixes.

FIG. 6 is an over head view showing a vulcanized pivot point at the top of a layout board structure with the copy window panel, opening from the bottom similar to a tablet opening.

FIG. 7 is an enlarged horizontal side view of FIG. 6 showing a close-up view of the copy window panel, vulcanized point having pivoting means, and layout board structure, face and back.

FIG. 7*a* is an extended horizontal side view of FIG. 7 showing the flexibility of a layout board structure embodiment.

Figure 8:
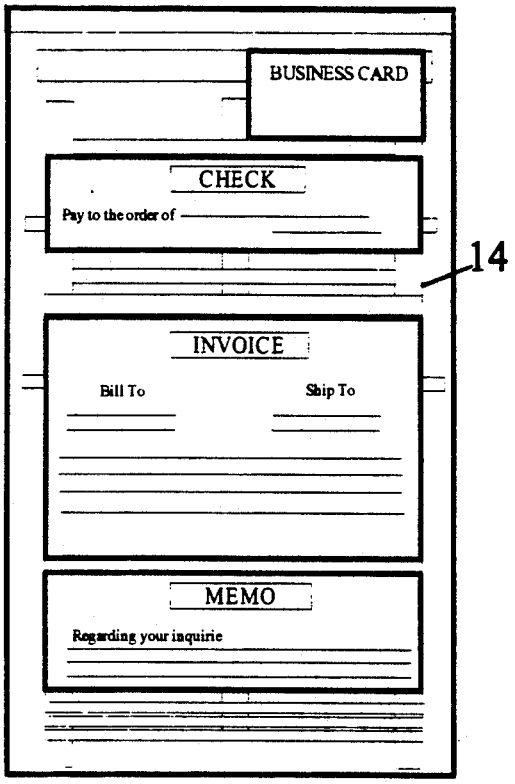

FIG. 8 is an overhead view of a layout board structure showing a business card, check, invoice, and memo placed in position with the copy window panel closed and ready for copy reproduction.

Figure 9A:
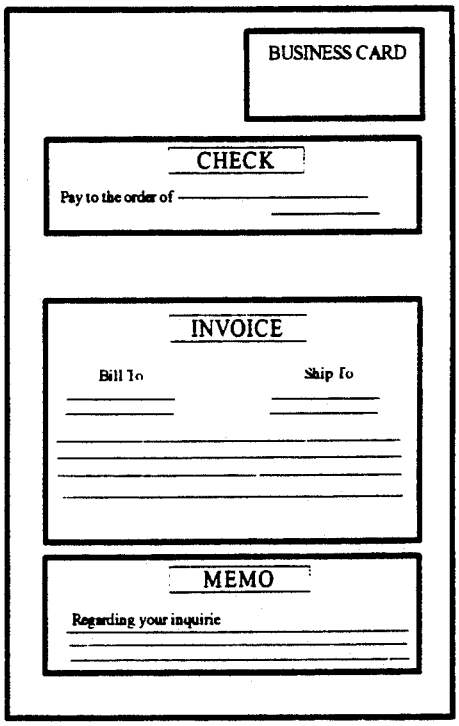
Figure 9:
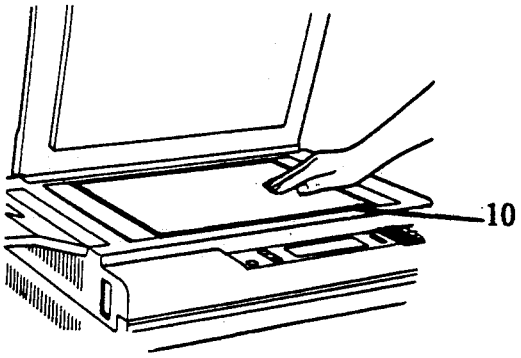

FIG. 9 shows a copy machine with the layout board structure placed copy window panel down on the glass matched up with copy machine gauge and layout board structure back gauge.

FIG. 9*a* shows an overhead view of a single sheet of paper that has been reproduced from FIG. 9 demonstrating the results after reproduction.

REFERENCE NUMERALS IN DRAWINGS

10: layout board structure
12: copy window panel
14: non-photogenic natured alignment grid
16: binder clamp
18: cutout recess
20: pivot point
22: layout board structure face
24: layout board structure back
26: layout board structure back gauge
28: pocket.

DESCRIPTIONS—FIGS. 1 to 7*a* and 9

Figure 1:
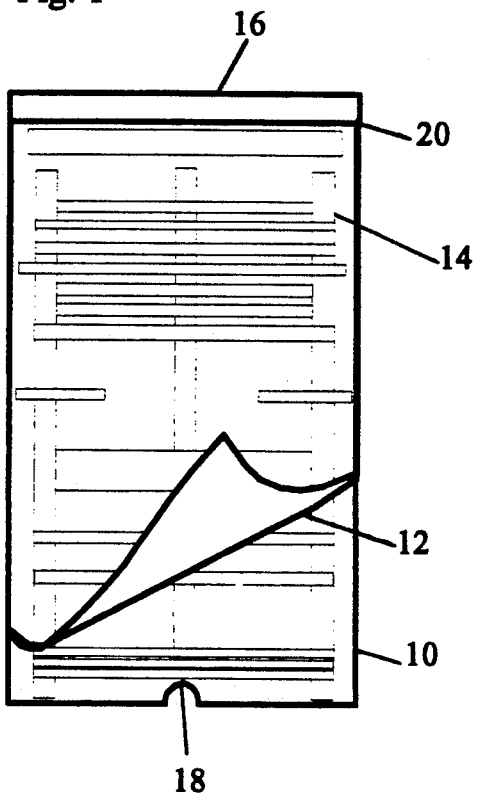
FIG. 1 is an overhead view showing the binder clamp and pivot point at the top of a layout board structure with the copy window panel opening from the bottom similar to a tablet.
Figure 2:
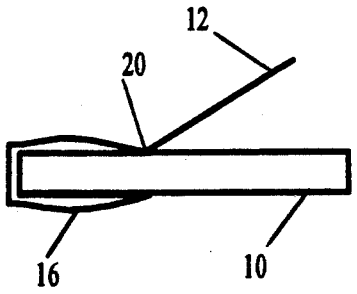
FIG. 2 is an enlarged horizontal side view of FIG. 1 showing a close-up view of the copy window panel, pivot point, binder clamp, and layout board structure.
Figure 3:
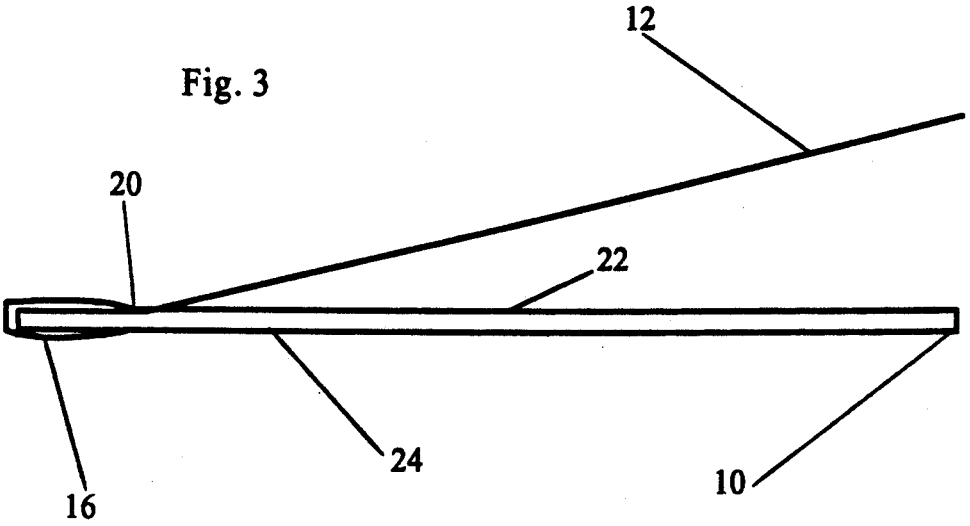
FIG. 3 is an extended horizontal side view of FIG. 1 showing layout board structure the layout board structure face and layout board structure back.

A typical embodiment of the layout board structure of this invention is illustrated in FIG. 1 (overhead view), FIG. 2 (enlarged horizontal side view), and FIG. 3 (extended horizontal side view). The embodiment has a thin layout board structure 10. consisting of a semi-rigid foam material with white paper laminated on both layout board face 22 and layout board back 24. A non photogenic natured alignment grid 14 is printed on the layout board face 22. The copy window panel 12. consists of a transparent, thin, flexible material which allows complete reproduction. The binder clamp 16 consists of a plastic clip with sufficient gripping power to firmly adjoin, at the pivot point 20, the layout board 10 and the copy window panel 12. A cutout recess 18 is notched in the center and at the bottom of the layout board 10. In the preferred embodiment, the layout board 10 is a one-eighth inch thick sheet consisting of a semi-rigid foam material with paper laminated on layout board structure face 22 and layout board structure back 24 such as Biefang foamboard available through Pacific Framing Supply Co. of Salem, Oreg. The layout board 10 can consist of any other material that is firm enough to accept and withstand the printing of non-photogenic natured alignment grid 14 upon which art work can be placed, arranged, and aligned. Any size that will facilitate the copy reproduction and art work process is acceptable. Any rigid or semi-rigid material that will work as a support structure on which art work can be arranged is acceptable. White is the preferred color, but any color that facilitates the reproduction process could be used. A size larger than standard size paper width of 8.5 inches has been used for the layout board 10 in the preferred embodiment. FIG. 9 a layout board back gauge 26 is printed on layout board back 24 to be used to a line the layout board 10 with the copy machine paper marker gauge that is provided with most copy machines. The non-photogenic alignment grid 14 printed on the layout board face 22 of the preferred embodiment is a light blue color. The shading casts very little reflection and is not reproduced by the black and white photo reproduction equipment. Any color or combination of colors and tints can be used as long as they are in the color range that bear non-photogenic reproduction qualities. The design or pattern of the non-photogenic alignment grid 14 can vary to meet the preferences of the user. It is conceivable to use a mixture of colors or to use a mixture of non-photogenic and photogenic colors, tints, or shades. An example could be a company logo printed with a black photogenic color and the non-photogenic alignment grid printed with a non-photogenic color. The black company logo would reproduce and the non-photogenic grid would not reproduce. The binder clamp 16 used in the preferred embodiment is that of a U-shape plastic clip sometimes used on report holders. However, any binding device or method could be used as long as it facilitates the adjoining and the fixing of the layout board 10 and the copy window 12 creating pivot point 20. It would also be possible for the copy window 12 and the layout board 10 to consist of one unit hinged at a pivot point 20 to allow the copy window 12 to be moved from an open to a closed position. The cutout recess 18 notched in the layout board 10 can be of any size and shape that will facilitate the opening and closing of the copy window 12.

Figure 4:
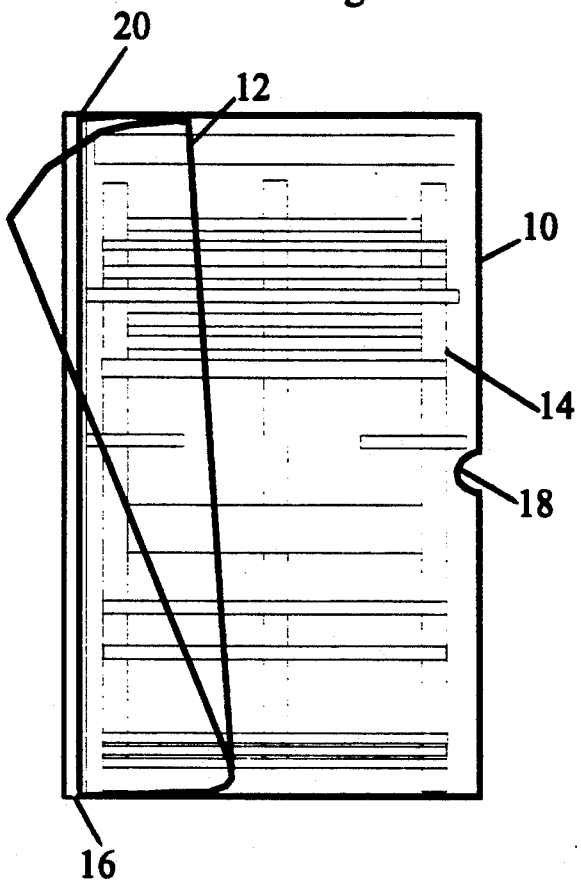
FIG. 4 is an overhead view showing the binder clamp at the left edge of the layout board structure with the copy window panel opening from the right edge similar to a book opening.
Figure 5:
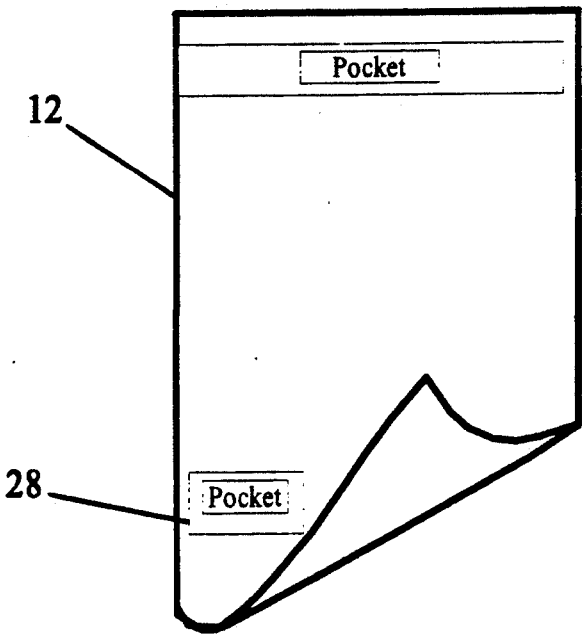
FIG. 5 is an overhead view of a copy window panel showing vulcanized insert pockets.

Additional embodiments are shown in FIG. 4 where the binder clamp 16 is mounted on the left side of the layout board 10. The copy window 12 opens from the right as a book opens and the cutout recess 18 is notched on the right side of the layout board 10. In FIG. 5, the copy window 12 is equipped with insert pockets 28 that could be used to insert company logos, routing information, or advertisements. Unlike the temporary non-photogenic alignment grid 14 these pockets could be used to store information subject matter that is permanent or semi-permanent in nature; information that does not change from one use to another. The pockets could be arranged in any configuration or size that would accommodate the user. FIGS. 6, 7, and 7*a* are all of the same type of embodiments. The variations of this embodiment are that the pivot point 20 is vulcanized to the layout board 10. In FIG. 7*a* the layout board 10 is made of a material having a nature that allows flexibility. While the layout board 10 is firm enough to support the holding and alignment of the subject matter, it must also accommodate a non-photogenic alignment grid 14. As mentioned earlier, the copy window 12 and the layout board 10 need not be two separate pieces. They could be of one continuous piece that is creased, hinged or has some method to create a pivot point. Though this embodiment shows a pivot point at the top it could just as easily be placed at any side of the layout board 10 to accommodate user preferences.

In FIG. 1 and FIG. 4 there are various possibilities with regard to the layout board 10, relative positioning of the binder clamp 16, the pivot point 20, and the cutout recess 18. In FIG. 1, the binder clamp 16, is at the top of the layout board 10 as is the pivot point 20. Though in this particular embodiment the cutout recess 18 is at the bottom of the layout board 10, the cutout recess 18 can be placed anywhere on the edge of the layout board 10. However, the cutout recess 18 is usually positioned at the opposite end of the layout board 10 where the pivot point 20 has been placed. The configuration can vary according to user preference. In FIG. 4 the binder clamp 16 and the pivot point 20 are at the left edge of the layout board 10 and the cutout recess 18 is at the right edge of the layout board 10. In FIG. 5, the copy window panel 12 has pockets that could be any size or shape that meets user needs. Another design could have two transparent copy window panels on the same side in order to sandwich original subject manner. It could also have an insert copy window panel that could be removed with each different desired use. FIGS. 6, 7, and 7*a* show a completely different design and use a different material for the layout board structure 10. This design is to accommodate greater thinness and flexibility for the layout board 10.

By using a combination of photogenic colored material for the layout board 10 and an identical color and shade with a different finish such as semi-gloss for the non-photogenic natured alignment grid 14, the user can see and use the alignment yet it cannot be seen by the color reproduction equipment. Another method is to imprint a non-photogenic grid 14 or an embossed grid onto the layout board face 22 where these non photogenic natured alignment grids can be seen by the user and the imprinted or embossed alignment grid will not be seen by color reproduction equipment.

From the descriptions above, a number of advantages of the reproduction layout board structure holding and alignment apparatus become evident:

(a) There is convenience and freedom to do lay out work in the employee work area or any place where the user has room enough to position the layout board. There is no longer the inconvenience or loss of costly wages waiting in line at the photo reproduction machine.

(b) There is independence from the use of any kind of adhesive type materials eliminating the cost of and time of applying these materials.

(c) It eliminates the requirement for paste up work. Art work can be over laid over the top of other art work and securely encased between the copy window panel and layout board making it ready for copy reproduction.

(d) Once the subject matter has been encased between the copy window and layout board, reproduction equipment is protected from damage caused by paper holding devices.

(e) It is a breakthrough in the field of reproduction of color subject matter, which cannot use unequal light colored shades and tints as an alignment methods. Instead, it is necessary to use colored shades and tints of equal value as an alignment grid. A non-photo reproduced alignment grid can be created by using a method that changes the surface structure of the layout board face, such as embossing, imprinting or a combination of gloss and semi-gloss ink finishes.

OPERATION—FIGS. 8, 9, AND 9*a*

The manner of using the layout board 10 in the copy reproduction is to:

a) Place layout board 10 on the work area, such as a desk or table top with the copy window panel 12 facing right side up towards the user.
b) Open the copy window 12 to the full open position.
c) Use the non-photogenic natured alignment grid 14 to align and arrange the subject matter to be reproduced into the desired position.
d) Close the copy window 12 partially allowing it to rest on the back of the user's hands.
e) Starting at the top of the layout board 10, work in a downward direction, gradually withdrawing hands while making the final alignment and arrangement of the subject matter, while allowing the copy window 12 to partially close and rest on subject matter
f) Close the copy window 12 completely FIG. 8 when the desired final layout configuration is obtained.
g) Lightly rub the copy window 12 using a soft, non-abrasive material to create a static electrical energy field which will secure the work.
h) Place the layout board face 22 down on copy machine glass.
i) Place the layout board 10 into correct position by matching the copy machine paper alignment indicator with the layout board back gauge 26.
j) Photo reproduce layout board 10 and encased subject matter.

SUMMARY, RAMIFICATION, AND SCOPE

Accordingly, the reader will note that the non-photogenic natured copy reproduction alignment and holding apparatus can be used conveniently to reproduce all kinds of desired subject matter. The user will not be hampered by the use of glues, tapes and other adhesive compounds previously associated with other layout devices and paste-up processes. Furthermore, the present invention has additional advantages. A design can consist of two copy window panels which are bound or adjoined to a layout board face and back giving it double-sided features. The size can range from less than 5 inches long by 8.5 inches wide, commonly known as memo size, to any size necessary to accommodate the task at hand. The layout board structure can be made of any firm or flexible material. Preferably it would be made of a material that will not allow scratching of copier glass or the lens of photo equipment. It can be made of self-gripping material or have a gripping material applied to the surface of the layout board. It can be of any color; however, white would be the preferred color for black and white photo reproduction. The layout board structure can be blank with a non-photogenic alignment means pressed or imprinted into the layout board. It can also have any variety of non-photogenic alignment grids; including an edge metering non-photogenic alignment ruler or a full layout board non-photogenic alignment grid. It can be of any desired color or non-color that would not be detected by the reproduction equipment. The layout board could be used on either one or more sides for a variety of company purposes. An additional layer of foam can be attached to the back of the layout board to create greater pressure on the subject matter being photo reproduced. The copy window panel can be clear, transparent, or non glare, frost-like finish. It can also be made of non-photogenic natured color. It can include an additional copy window panel insert for temporary insertion. It can be of any thickness that accommodates the end use. The printing can be of both photogenic and non-photogenic nature so long as it meets the users needs. It can be bound to the layout board structure on one or more sides. Additional advantages in that:

it permits the use of constant subject matter reproduction by using a photogenic color on either the layout board or copy window panel or a combination of both elements allowing reproduction apparatus to reproduce the desired photogenic subject matter.

it permits selective reproduction by using a combination of both photogenic and non-photogenic colors. For instance, if company routing information was printed with non-photogenic natured means and a company logo was printed with photogenic means, the user could read and follow the routing information printed on the layout board structure yet this information would not be seen by the reproduction equipment and only the company logo would reproduce.

because of the layout board structure's, flexibility of materials, and colors, it can be manufactured and customized for the individual business; personalized for the individual user, or adapted for the individual photo reproduction machine.

it can be used for a company information flow control device or a procedure and policy tool by having customized routing information or procedure and policy directives printed on one or more sides of the layout board.

it can be used as a promotional or advertisement implement with customized printing on layout board structure face or back. Also, the copy window panel will support and allow for the use of photogenic printing.

it can be manufactured in a size that is portable. It can be put into a brief case and taken to printers, meetings, business trips, or home.

it is simple in application and can be used by the novice as well as a person experienced in the art.

it can be used in any type of art photo reproduction and can replace the old style of layout and design board as well as previously practiced paste-up processes.

it can be used in black and white photo reproduction work as well as in color photo reproduction work.

it has practical application in small and large business as well as government and private organizations. The users and usages are seemingly endless.

Although the description above contains many specificities, these should not be construed as limiting the scope of the invention but as merely providing illustrations of some of the presently preferred embodiments of this invention. For example, the layout board structure can have other shapes, such as circular, oval, trapezoidal, triangular, etc.; the copy window panel could have the same shape. The layout board structure as well as the copy window panel can be made of a variety of thicknesses or materials so long as it accommodates the users prescribed end use. The printed layout board non-photogenic natured alignment grid can be of any design, color, or combination of colors, shades or tints so long as it is not reproduced by the photo copy reproduction apparatus. In the case of color reproduction work the color is seen and reproduced but the alignment method is not. The layout board structure and copy window panel's adjoining binding method can include, but not be limited to clamps, vulcanization, stitching, tapes, glues or other adhesives. Also the copy window structure and layout board can be of one continuous piece having a crease, hinged or other mechanism to create a pivot point that facilitates the opening and closing of the copy window panel.

Thus the scope of the invention should be determined by the appended claims and their legal equivalents, rather than by the examples given.

I claim:

1. A document holding and aligning apparatus, comprising:

a substantially rigid board having a surface with a plurality of non-photogenic alignment marks, and a substantially transparent and flexible cover sheet positioned over said surface of said board, said cover sheet having an edge attached to said board, whereby one or more pieces of documents can be individually positioned by said alignment marks on said board and securely held between said board and said cover sheet for photo-reproduction or scanning of said documents.

2. The document holding and aligning apparatus of claim 1 wherein said board comprises a sheet of substantially rigid foam.

3. The document holding and aligning apparatus of claim 1, further including a cutout recess on said board for allowing said cover sheet to be easily lifted from said board.

4. The document holding and aligning apparatus of claim 1, further including one or more substantially transparent pockets attached to said cover sheet for holding said documents at one or more fixed positions over said board.

5. The document holding and aligning apparatus of claim 1, further including an elongated clip for clipping said edge of said cover sheet to said board.

6. The document holding and aligning apparatus of claim 1 wherein said non-photogenic alignment marks are light blue.

7. A document holding and aligning apparatus, comprising:

a substantially rigid board having a surface with a plurality of non-photogenic alignment marks, a substantially transparent and flexible cover sheet positioned over said surface of said board, a cutout recess on said board for allowing said cover sheet to be easily lifted from said board, and an elongated clip for attaching an edge of said cover sheet to said board, whereby one or more pieces of documents can be individually positioned by said alignment marks on said board and securely held between said board and said cover sheet for photo-reproduction or scanning of said documents.

8. The document holding and aligning apparatus of claim 7 wherein said non-photogenic alignment marks are light blue.

9. The document holding and aligning apparatus of claim 7, further including one or more substantially transparent pockets attached to said flexible cover sheet for holding said documents at one or more fixed positions over said board.

10. A document holding and aligning apparatus, comprising:

a substantially rigid board, a plurality of non-photogenic alignment marks disposed on said board, and a substantially transparent cover sheet positioned over said board, said cover sheet having an edge pivotably attached to said board, whereby one or more pieces of documents can be individually positioned by said alignment marks on said board and securely held between said board and said cover sheet for photo-reproduction or scanning of said documents.

* * * * *